United States Patent [19]

Beiter

[11] Patent Number: 4,645,211

[45] Date of Patent: Feb. 24, 1987

[54] NOCK FOR ARROWS OF SPORT AND HUNTING BOWS

[76] Inventor: Werner Beiter, Daimlerstrasse 18, 7735 Dauchingen, Fed. Rep. of Germany

[21] Appl. No.: 900,621

[22] Filed: Aug. 26, 1986

[30] Foreign Application Priority Data

Aug. 31, 1985 [EP] European Pat. Off. ..... 85111005.6

[51] Int. Cl.[4] ..... F41B 5/02

[52] U.S. Cl. ..... 273/416

[58] Field of Search ..... 273/416

[56] References Cited

U.S. PATENT DOCUMENTS 3,010,446 11/1961 Frantello ..... 273/416 X 3,214,174 10/1965 Saunders ..... 273/416

4,305,588 12/1981 Dodge ..... 273/416

FOREIGN PATENT DOCUMENTS 1470802 4/1977 United Kingdom ..... 273/416

OTHER PUBLICATIONS

Bow & Arrow, 6/1981, p. 26, Pro Nock.

*Primary Examiner*—Paul E. Shapiro

*Attorney, Agent, or Firm*—Leonard Bloom

[57] ABSTRACT

A nock for arrows is disclosed. This nock is formed so that at all times during spanning of the bow and firing of the arrow, the nock-location section of the bowstring will be received in the nock so that the collar lies evenly against the bottom of the furrow of the nock for accurate firing of the arrow.

9 Claims, 5 Drawing Figures

NOCK FOR ARROWS OF SPORT AND HUNTING BOWS

FIELD OF THE INVENTION

The present invention relates to a nock for arrows of sport and hunting bows.

BACKGROUND OF THE INVENTION

The nock is the part of the arrow which is notched to receive therein the bowstring. The nock is usually positioned on the end of the shaft of an arrow, whereby upon placing the arrow on the bowstring, the nock, with its lateral projections (nock-wings), grips the bowstring. In order to properly establish and mark the portion of the bowstring which should be received within the nock of the arrow, a pair of bands (a nock-location collar) are attached to the bowstring between which is the portion of the bowstring to be received within the nock. It is important that the collar be received and retained in the knock during spanning and firing of the arrow.

Unfortunately, when firing, the bowperson grips the bowstring either with: (1) his/her index finger above the nock-location collar and the middle and remaining fingers below said section; or (2) using the so-called "lower grip", said bowperson grips the bowstring below said collar. In either case, the point of maximum extension of the bowstring, during the spanning of the bow, is below the nock-location collar. Thus, prior to firing the bowstring is tilted upwardly at an angle of up to 30° in the region of the nock-location collar with respect to the bottom of the furrow of the nock (which is formed by the projections or nock-wings) which is perpendicular to the axis of the arrow. This tilting creates problems in that it tends to keep the collar from being properly retained in the nock. Upon firing, the arrow leaves the bowstring when the latter is released from its tensed state by the bowperson and has reached its normal relaxed state. In its normal relaxed state, the bowstring runs parallel to the bottom of the furrow of the nock. This creates problems by requiring that the bottom of the furrow run parallel to the bowstring in its relaxed state.

The two bands defining the nock-location collar on the bowstring have, as a rule, a separation therebetween corresponding to the diameter of the nock, in order to define the section of the bowstring where the nock may be located as accurately as possible. The tilting of the pulled bowstring has the result that the upper band pushes down upon the nock in front of the furrow, whereas the lower band pushes against the bottom of the projections from behind the furrow. Consequently, a tilt moment is applied to the entire arrow which pushes against the alignment of the arrow shaft on the bow. This tilt moment impairs the accuracy of the shot. Under certain conditions, the pressure exerted through the bands upon the nock can even lead to the breaking off of the nock from the arrow shaft.

Nocks of the prior art have been disclosed which have attempted to solve the problems enumerated above by having a furrow formed between the nock projections (nock-wings) in which, at least at its bottom, has a width which is a bit smaller than the diameter of the bowstring. The nock thereby sits upon the bowstring slightly pinched. This is disadvantageous in that when the bow is pulled, the bowstring tilts against the bottom of the furrow of the nock and lifts itself from the bottom of the furrow. With the bow pulled, the collar no longer sits accurately within the nock. Additionally, if the bowstring is released by the bowperson during the discharge of the arrow, then the bowstring strikes against the bottom of the furrow in an irregular manner, resulting in inconsistencies in the discharge of the arrow and in the arrow deviating from its intended flight.

In the West German Utility Model Registration No. DE-GM No. 83 05 301 there is disclosed a nock of the general type mentioned previously. In this nock, ribs are formed on the inner sides of the projections extending to the rear of the bottom of the furrow, which are transverse to the axis of the arrow and are parallel to the bottom of the furrow. These ribs narrow the furrow to such an extent, so that the bowstring, when received in the nock, is seated on the bottom of the furrow, in front of the ribs, being held in the nock with a slight holding force. This holding action holds the nock fast upon the bowstring. If the bowstring is tilted during the spanning of the bow, then it tilts against the canal defined between the bottom of the furrow and the ribs. This disadvantageously creates the danger that the bowstring may jump out of the seat or become otherwise unseated. The arrow then sits with the nock-location collar of the bowstring being no longer received within the nock and can even fall off from the bowstring. In addition, with the nock disclosed in West German Utility Model Registration No. DE-GM No. 83 05 301, the bottom of the furrow is arched in a convex fashion with respect to its peripheral ends, in order to guarantee the accurate alignment of the nock-location collar of the bowstring with the bottom of the furrow of the nock, even during the tilting of the pulled bowstring. This convex arching of the bottom of the furrow, however, has the result that the bowstring at any one time is only in point contact with the bottom of the furrow. Because of this point contact, the arrow, particularly at the moment during the discharge-firing-thereof when it leaves the bowstring, is not accurately directed by the nock-location collar of the bowstring.

Accordingly, there remains a need to create a nock which, when the bowstring is extended during the spanning of the bow and the discharge of the arrow, will be held dependably against the nock-location collar of the bowstring and which at all times permits the nock-location collar of the bowstring to lie evenly against the bottom of the furrow of the nock, for the accurate direction of the arrow.

SUMMARY OF THE INVENTION

Accordingly, it is the primary objective of the present invention to alleviate the disadvantages and deficiencies of the prior art by providing a nock which at all times permits the nock-location collar of a bowstring to be evenly against the bottom of the furrow of the nock for the accurate firing of the arrow.

In accordance with the teachings of the present invention, a nock for arrows of sport and hunting bows is disclosed. This nock is of the type having a nock body attachable to the end of the arrow shaft. Two nock-wings are formed on the end of the nock-body, wherein a diametrically running furrow is formed for accepting the nock-location defining section of a bowstring. Ribs are formed on the inside of the nock-wings, thereby narrowing the furrow at the end opposite the bottom. Said ribs run perpendicular to the arrow axis. A first peripheral cut-off formed on the ribs at the bottom of the furrow. Said first cut-off is inclined with an acute angle with respect to the perpendicular axis of the arrow in the direction towards the arrow shaft. Each nock-wing has a second peripheral cut-off formed therein. Said second cut-off is inclined with an acute angle with respect to the perpendicular axis of the arrow in the direction towards the end of the nock. A first circular notch is formed on the bottom of the furrow at the peripheral end of the first cut-off. A second circular notch is formed in the ribs at the inclined peripheral ends of the second cut-off. Each of said circular notches are positioned perpendicular to the direction of inclination of the cut-offs for the purpose of receiving the bands defining the nock-location of the bowstring. In one embodiment, the first cut-off and the second cut-off are inclined at equal acute angles. In a second embodiment, the inclination of the acute angle of the first and second cut-off is substantially 30°. In another embodiment, the first and second inclined cut-offs involve about half to a third of the diametrical extending length of the furrow. In still another embodiment, the separation of the circular notches perpendicular to their planes, corresponds to the diameter of the nock-body in the direction of the bottom of the furrow. In yet another embodiment, the nock-wings are formed to be elastically resilient in the portion thereof extending from the region of the bottom of the furrow to the ribs. Said nock-wings further have an essentially constant minimum wall thickness in the diametrical direction thereof being perpendicular towards the furrow. In yet still another embodiment, the nock-body is formed being essentially tapered in shape, narrowing from the end that attaches to the arrow shaft up to the nock-wings. In a still further embodiment, the nock-body possesses an essentially square cross-section in the region thereof wherein the nock-wings extend therefrom, such that a diametrical pair of outside surfaces form part of the outside surfaces of the nock-body of the nock-wings.

In further accordance with the teachings of the present invention, a nock for arrows having a shaft, to receive the nock-location section of a bowstring therein, is disclosed. Said nock is of the type including, a removable nock-body slidably received on the shaft. A pair of projections are integral with and extending rearwardly from the nock. Said projections define a diametrically running furrow therebetween, wherein the nock-location defining section of the bowstring is received. A pair of ribs are formed on each of said projections within the furrow on an axis being perpendicular to the longitudinal axis of the arrow. A reduced area of the furrow is thereby formed dividing said furrow into a rearward entrance portion, wherein the nock-location section of the bowstring is received in the nock, and a forward closed portion, wherein the nock-location section of the bowstring is seated during the loading and firing of the arrow.

Each of said projections further have a first cut-off formed therein on the forward upper portion of the recessed portion. Said cut-off is inclined at an acute angle in the direction of the arrow with respect to the longitudinal axis thereof.

Each of said ribs has a second cut-off formed therein on the lower portion thereof. Said second cut-off is inclined at an acute angle in the direction of the arrow with respect to the longitudinal axis thereof. A first circular notch is formed in the nock-body in a location at the peripheral end of the first cut-off on a plane intersecting said first cut-off. A second circular notch is formed in the ribs in a location at the peripheral end of the second cut-off on a plane intersecting said second cut-off. Wherein the angle of inclination of the first and second cut-offs are substantially aligned and the first and second circular notches are so formed as to receive therein the nock-location section of the bowstring.

DESCRIPTION OF PREFERRED EMBODIMENT

Figures 1, 2, 3:
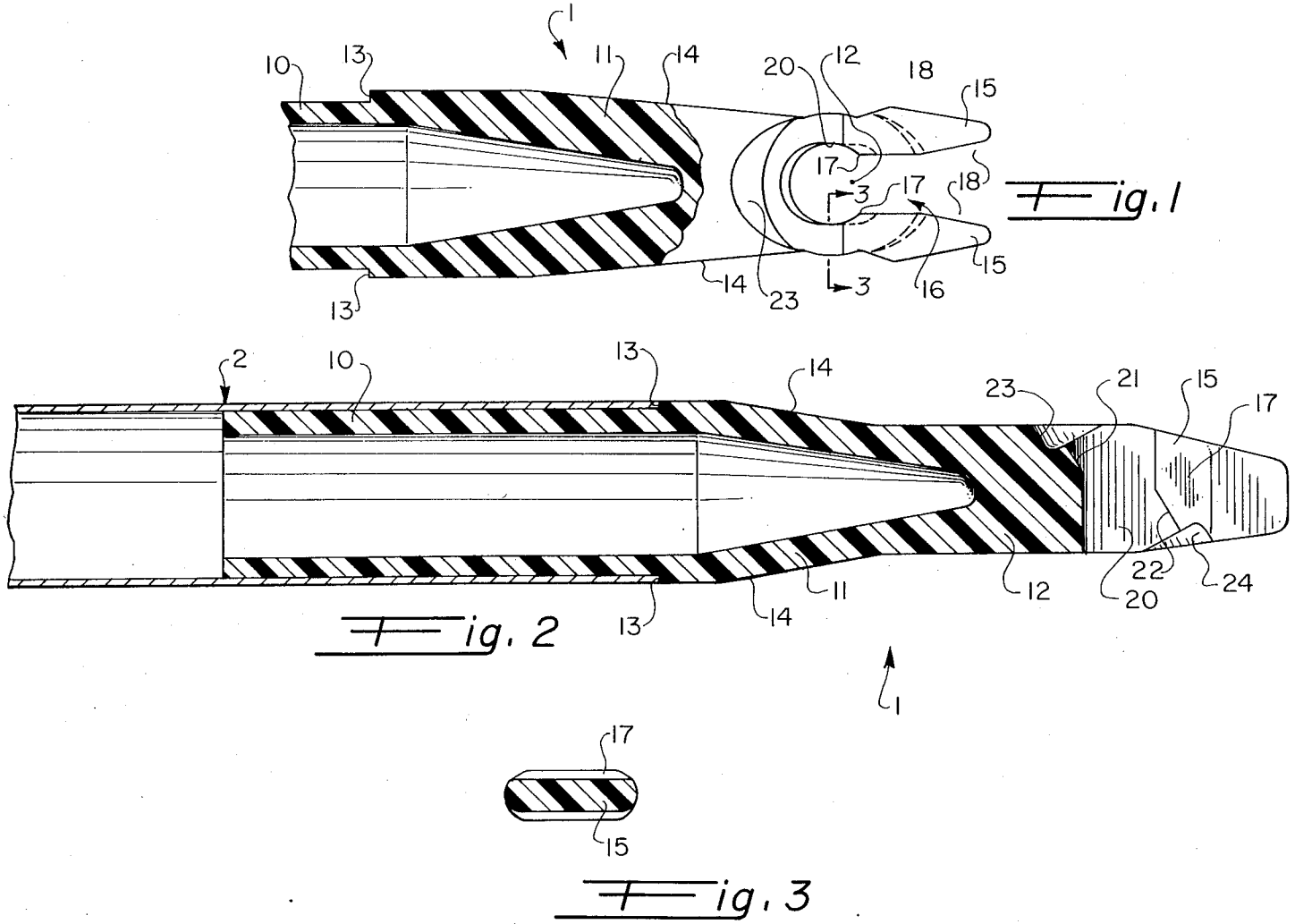
FIG. 1 is a top plan view, in partial cross-section, of the nock of the present invention.
FIG. 2 is a side view taken along lines 2—2 of FIG. 1.
FIG. 3 is a cross-sectional view taken along lines 3—3 of FIG. 1.

With reference now to FIGS. 1–3, the nock 1 is comprised of having a forward mounting portion 10 of reduced diameter, a main body portion 11 and a rearward furrow portion 12. A shoulder 13 is defined between the mounting portion 10 and the main body portion 11, due to the mounting portion 10 being formed having a reduced diameter. The mounting portion 10 is further formed having an outer circumference being in agreement with the inner diameter of the shaft of the arrow 2 upon which it is to be slidably, removably received. The nock 1 can be inserted with the mounting portion 10 fitting into the hollow end of the shaft of the arrow 2 until said shaft abuts flush against the shoulder 13. Preferably, the mounting portion 10 of the nock 1 is hollow in order to conserve material and weight and to make possible a precise shaping.

The main body portion 11 is, preferably, formed being externally tapered as it approaches the rearward furrow portion 12, so that at the point where the main body portion 11 is integral with the furrow portion 12, the external configuration of the nock 1 is substantially square in cross-section. [As shall be further seen later, the shaping of the nock 1 with a square cross-section makes possible the formation of the projections (nock-wings) 15 with constant slight wall thickness without the disadvantage of creating break-prone areas at the point of this cross-section.] To this end, the main body 11 is preferably externally configured having four lateral surfaces 14. Two opposing lateral surfaces 14, those which are located on the top of the nock 1 and on the bottom of the nock 1 taper having an angle of about 10° and, prior to meeting the furrow portion 12, complete tapering and become parallel to one another (see FIG. 2). The other two lateral surfaces 14, those which are located on either side of the nock 1, taper having a slightly smaller angle of approximately 6° and continue tapering until they meet the furrow portion 12 (See FIG. 1). This tapering has the advantage of presenting a nock 1 which has a smaller axial end surface upon which a subsequent arrow 2, in the so-called "Robin-Hood shot", can hit and destroy the nock 1 and the arrow 2. If a subsequent arrow 2 strikes this tapering portion, it does not destroy the nock 1, but, rather is deflected. In addition, the subsequent arrow will also be less strongly diverted from its aim.

The rearward furrow portion 12 is comprised of a pair of outwardly extending projections (nock-wings) 15, each being integral with and extending outwardly from the rear of main body portion 11 of the nock 1. Said projections (nock-wings) 15 define a diametrically running furrow 16 therebetween. Furrow 16 runs transverse to the axis of the shaft of the arrow 2. Furrow 16 serves for the guiding into, and seating therein, of either the bowstring or of a bowstring attached nock-location collar.

Upon the inner surfaces of each of the projections (nock-wings) 15 are a pair of ribs 17 which are oriented on an axis perpendicular to the axis of the shaft of the arrow 2. Ribs 17 thereby form a reduced area of the furrow 16 having a width being a bit smaller than the diameter of the bowstring or the nock-location collar. Ribs 17 divide the furrow into a rear entrance section 18 wherein the bowstring and/or collar are received in and guided into the furrow 16 and a forward closed section 19 wherein the bowstring and/or collar are seated during loading and/or firing of the arrow 2.

The furrow 16 of the rearward entrance section 18 is preferably substantially converging, being wider at the entrance portion than where the ribs 17 are located. The furrow 16 of the forward closed portion 19 is, immediately adjacent to the ribs 17, preferably wider than the remainder of the furrow 16, thereby forming on each of the projections (nock-wings) 15 a recessed portion 20 being substantially parallel to and immediately adjacent to the ribs 17. The furrow 16 of the forward closed portion 19 is further, at its closed end, accurately formed. To this end, the closed section 19 of the furrow 16 is formed having a substantially circular cross-section corresponding to the cross-section of either the bowstring or the nock-location collar.

The projections (nock-wings) 15 are formed so that that portion of each projection 15 which defines the forward section of the furrow 16 has a substantially constant small wall thickness of about 1 mm (FIGS. 1 and 3). The external walls of the projections 15 are, about the closed section of the furrow 19, (and due to the recessed portion 20), accurately formed having an angle of about 15° with respect to the longitudinal axis of the arrow shaft 2.

It should be noted that the recessed portion 20 thus formed and described above is sized to receive therein either the bowstring or the collar when relaxed during the loading and/or firing of the arrow.

The projections (nock-wings) 15 are further formed so that that portion of each projection 15 which defines the rearward section of the furrow 16 are fabricated from resilient materials. Due to the small wall thickness and these resilient materials, the projections deflect outwardly during the discharge of the arrow when the nock separates from the bowstring/collar. The nock 1 is thereby not held in the closed section of the furrow 19 by a clamping action, but rather, surrounds it elastically. Such an arrangement is especially advantageous when a collar is placed on the bowstring. The force with which this stiff collar is held in the nock 1 and the resistance experienced during the release of the collar from this nock 1 during firing is accordingly determined only by the elastic bending resistance and depends very little upon unavoidable production tolerances. This elastic bending resistance moreover comes into play only at the moment at which the bowstring, or the collar, snaps out of the forward close section of the furrow 19. This effect is timewise very short and spacewise limited precisely by the narrowing of the furrow 16 by the ribs 17. There cannot, therefore, appear any undefined influences which would impair the precision of the seating of the collar during the release of the nock 1 from the bowstring upon the discharge. This is a significant advantage over traditional nocks, which sit upon the nock-location collar of the bowstring under a clamping action, and in which the width of the furrow of the nock is chosen slightly smaller than the diameter of the bowstring. The seating of the nock-location collar of the bowstring in the bottom of the furrow of the nock without clamping action also has, as opposed to traditional nocks having clamping action, the additional advantage in that no significant wear of the projections 15 appears. Such wear would influence the accuracy, as it would alter the frictional and force relationships between the nock 1 and the collar.

The forward, uppermost portion of the recessed portion 20 has a cut-off (first cut-off) 21 which is inclined forwardly towards the shaft of the arrow 2 at an angle of about 30° with respect to the longitudinal axis of the arrow shaft 2. This inclined cut-off 21 further preferably extends over approximately a third of the height of the recessed portion 20 (FIG. 2).

The lowermost portion of each of the ribs 17 likewise, is provided having a cut-off (second cut-off) 22 formed therein, which is inclined forwardly towards the shaft of the arrow 2 at an angle of about 30° with respect to the longitudinal axis of the arrow shaft 2. This cut-off 22 further preferably extends over about half of the total height of the ribs 17 (FIG. 2). The inclined cut-offs 21 and 22 each extend preferably less than half the diametric measurement of the furrow and, in particular, always a bit over a third of this diametric measurement. Thereby, in the middle region and in over approximately a third of the diametric measurement of the furrow 16, the bottom of the furrow 16 and the bottom of ribs 17 run together in a substantially parallel fashion and substantially perpendicular to the axis of the arrow 2, so that during the moment of discharge when the nock separates from the bowstring, the arrow is directed exactly perpendicular to the bowstring.

At the peripheral end of the inclined cut-off 21, a circular notch (first circular notch) 23 is provided with a diameter greater than the diameter of the furrow 16 in the forward closed section 19. Notch 23 is positioned in a plane which intersects the inclined cut-off 21. At the peripheral end of the inclined cut-off 22 of the ribs 17 there is likewise provided a circular notch (second circular notch) 24, which has a diameter larger than the diameter of the furrow 19. Notch 24 is positioned in a plane which intersects the inclined cut-off 22. The mutual separation distance of the notches 23 and 24 perpendicular to their planes corresponds to the diameter of the nock and thereby to the separation of the nock-location determining bands of the collar on the bowstring.

The notches 23 and 24 preferably always have a radius greater than the radius of the forward closed section of the furrow 19 and are located in a plane which intersects the plane of the slope direction of the sloping cut-offs 21 and 22. During the tilting of the bowstring in its maximum extension, these cut-offs 21 and 22 serve the purpose, of receiving the bands which define the nock-location collar on the bowstring. Even when the bands have a mutual separation corresponding only to the diameter of the nock 1, these bands, during the tilting of the bowstring, do not exert any pressure upon the nock 1 which could disadvantageously influence the flight accuracy of the arrow or which could cause a breaking off of the nock 1 from the arrow shaft 2. The nock-location defining bands of the collar can thereby be placed with the minimum separation, corresponding to the diameter of the nock 1, which makes possible an accuracy determining precise positioning of the nock 1 upon the bowstring. The band locking into the cut-out of the ribs 17 also prevents, in particular, the nock-location collar from becoming unseated during the tilting of the bowstring.

As thus described, the top of the furrow 19, upon which the nock-location collar rests, and the ribs 17 are formed asymmetrically. The asymmetric bevelling of the bottom of the furrow and of the ribs 17 allows for a tilting of the bowstring during the spanning of the bow without the nock-location collar pushing upon the nock 1 and applying a tilt moment to the arrow 2, without the bowstring being able to escape from its seated position. Due to the formation of the bottom of the furrow, the bottom of the furrow has a sufficiently large section perpendicular to the axis of the arrow, so that at the moment of discharge of the arrow, when the nock separates from the bowstring, there is a sufficiently large contact area between the bottom of the furrow of the nock. This large contact area guarantees a good transfer of force from the bowstring to the arrow and, provides an accurate, accuracy precise launch of the arrow by the bowstring at the moment of discharge. The shape of the ribs 17 guarantees that the nock-location collar, during the spanning and firing operations, is continually in contact with the bottom of the furrow of the nock and is not able to become unseated. The nock-location collar thereby does not at any time during the entire event separate itself from the bottom of the furrow so that no imprecise positioning of the nock-location collar with respect to the nock can occur which influences the precision of the discharge.

Figure 4:
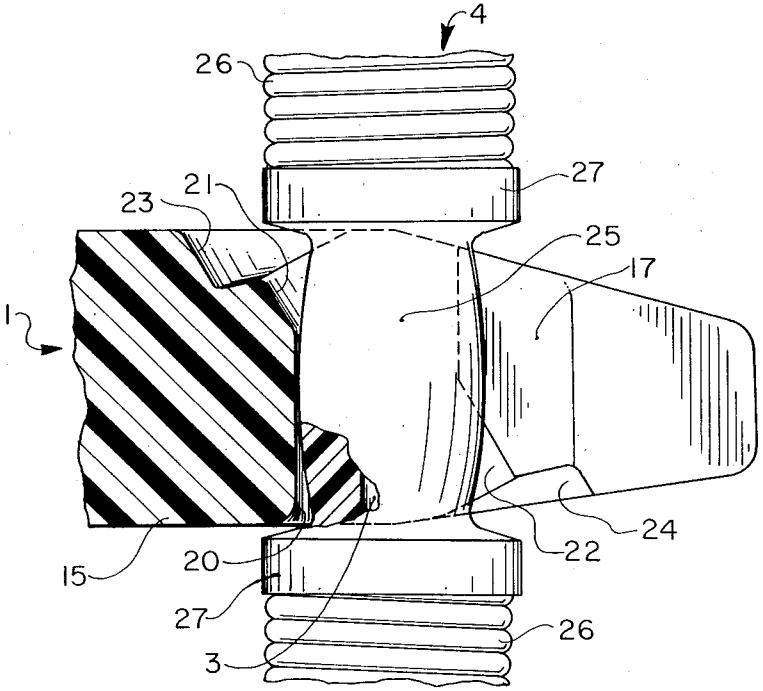
FIG. 4 is a side view, in cross-section, of one of the projections (nock-wings) of the nock showing the positioning of the bowstring therein when relaxed and with part of the collar broken away and sectioned to show the bowstring in the collar.
Figure 5:
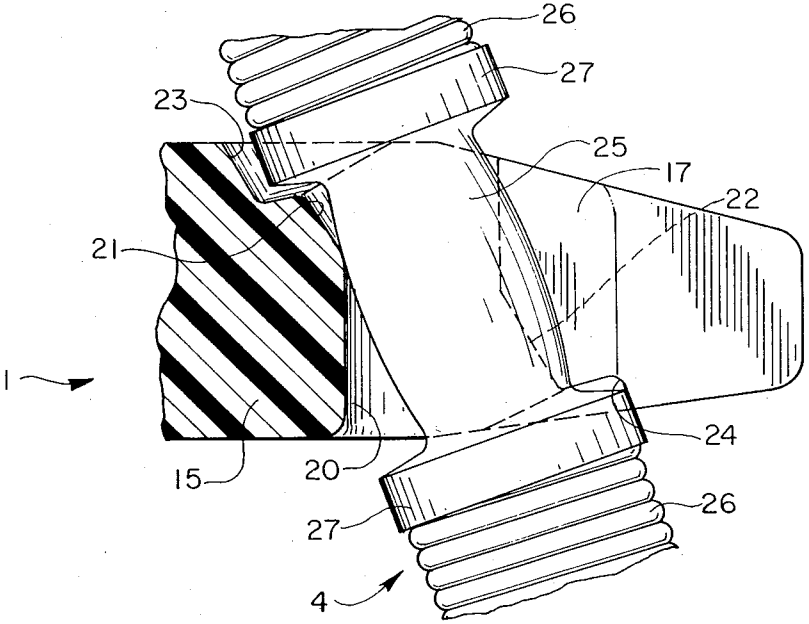
FIG. 5 is a side view, in cross-section, of one of the projections (nock-wings) of the nock showing the positioning of the bowstring therein when tensed.

With reference now to FIGS. 4 and 5 there is illustrated on an enlarged scale the nock having a nock-location collar 4 positioned therein for explaining the function of the nock 1. On the string of the bow is attached the nock-location collar 4 in which is received the nock 1. Collar 4 is comprised of a stiff collar portion 25 centered between a filament winding 26. The collar 25 has two bands 27 separated with a distance corresponding to the diameter of the nock-body in the region of the forward closed section of the furrow 19, so that a precise positioning of the arrow upon the bowstring 3 is guaranteed. The diameter of the collar 25 corresponds substantially to the diameter of the recessed portion 20.

When the arrow with the nock 1 is placed upon the bowstring 3, then the collar 25 rests in the recessed portion 20 and is held in the recessed portion 20 by the ribs 17. For the seating of the collar 25, the projections 15 are slightly bent elastically apart. The collar 25 then takes the position shown in FIG. 5.

When during the spanning of the bow the bowstring is pulled, whereby the fingers of the bowman grip predominantly or completely under the nock-location collar 4 of the bowstring, then the bowstring tilts in the region of the nock-location collar 4 up to 30° with respect to the perpendicular to the original arrow axis. This is shown in FIG. 4. The stiff collar 25, which defines the nock-location, tilts therewith up to 30° with respect to the recessed portion 20 which is perpendicular to the arrow axis. The inclined cut-offs 21 of the recessed portion 20, and 22 of the ribs 17, make possible this tilting without the collar 25 freeing itself from the forward closed section of the furrow 19 and without the collar 25 becoming unseated by jumping out rearwardly through the ribs 17. The bands 27 of the collar 25 are positioned during this tilting of the bowstring in the notches 23 and 24, so that the bands 27 do not exert any pressure upon the nock 1 which would result in a tilt moment acting upon the arrow.

When the string of the bow is released for the discharge, it returns again to its resting position shown in FIG. 5, as the arrow separates from the bowstring 3. As a comparison of FIGS. 4 and 5 shows, the collar 25 remains continually in contact with the recessed portion 20, and is held continually in contact with this recessed portion 20 by the ribs 17 during the entire event of the acceleration of the arrow, during which the bowstring moves from the position of maximum extension shown in FIG. 4 to the position at the moment of discharge shown in FIG. 5. Thus, during the entire acceleration of the arrow, there cannot occur any undefined position relationship between the nock 1 of the arrow and the nock-location collar 4 of the bowstring 3 which could lead to target inaccuracy. As is shown in FIG. 5, at the moment of discharge when the nock separates from the nock-location of the bowstring, there exists a sufficiently large contact area of the collar 25 with the recessed portion 20 in the diametrical direction, so as to direct the arrow in a direction precisely perpendicular to the bowstring.

Finally it should be noted that, for practical reasons the nock is preferably injection molded, as one piece . The nock is preferably formed of thermoplastic synthetic material of high strength in order to avoid breakage and where such material should also provide high elasticity in order to guarantee an easy seating and release of the bowstring, with good sliding properties in order to achieve an easy and wear-free release of the nock from the bowstring. This requirement is met by such material as polyoxymethylene, polyamide and polycarbonate.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. Nock for arrows of sport and hunting bows of the type having a nock body attachable to the end of the arrow shaft, two nock wings formed on the end of the nock body, wherein a diametrically running furrow is formed for accepting the nock-location defining section of a bowstring, ribs formed on the inside of the nock-wings, thereby narrowing the furrow at the end opposite the bottom, said ribs running perpendicular to the arrow axis, the improvement thereupon comprising: a first peripheral cut-off formed on the ribs at the bottom of the furrow, said first cut-off being inclined with an acute angle with respect to the perpendicular axis of the arrow in the direction towards the arrow shaft; each nock-wing having a second peripheral cut-off formed therein, said second cut-off being inclined with an acute angle with respect to the perpendicular axis of the arrow in the direction towards the end of the nock, a first circular notch formed on the bottom of the furrow at the peripheral end of the first cut-off, and a second circular notch formed in the ribs at the inclined peripheral ends of the second cut-off, each of said circular notches being positioned perpendicular to the direction of inclination of the cut-offs for the purpose of receiving the bands defining the nock-location of the bowstring.

2. The nock according to claim 1, wherein the first cut-off and the second cut-off are inclined at equal acute angles.

3. The nock according to claim 2, wherein the inclination of the acute angle of the first and second cut-off is substantially 30°.

4. The nock according to claim 1, wherein the first and second inclined cut-offs involve about half to a third of the diametrical extending length of the furrow.

5. The nock according to claim 1, wherein the separation of the circular notches perpendicular to their planes, corresponds to the diameter of the nock-body in the direction of the bottom of the furrow.

6. The nock according to claim 1, wherein the nock-wings are formed to be elastically resilient in the portion thereof extending from the region of the bottom of the furrow to the ribs, said nock-wings further having an essentially constant minimum wall thickness in the diametrical direction thereof being perpendicular towards the furrow.

7. The nock according to claim 6, wherein the nock-body is formed being essentially tapered in shape, narrowing from the end that attaches to the arrow shaft up to the nock-wings.

8. The nock according to claim 7, wherein the nock-body possesses an essentially square cross-section in the region thereof wherein the nock-wings extend therefrom, such that a diametrical pair of outside surfaces of the nock-body form part of the outside surfaces of the nock-wings.

9. A nock for arrows having a shaft, to receive the nock-location section of a bowstring therein, said nock being of the type including, a removable nock body slidably received on the shaft;

a pair of projections being integral with and extending rearwardly from the nock, said projections defining a diametrically running furrow therebetween, wherein the nock-location defining section of the bowstring is received;

a pair of ribs formed on each of said projections within the furrow on an axis being perpendicular to the longitudinal axis of the arrow, thereby forming a reduced area of the furrow and dividing said furrow into a rearward entrance portion, wherein the nock-location section of the bowstring is received in the nock, and a forward closed portion, wherein the nock-location section of the bowstring is seated during the loading and firing of the arrow;

wherein the improvement comprises:

each of said projections further having a recessed portion formed therein, whereby a lateral channel is formed in the forward closed portion of the furrow to receive therein the nock-location section of the bowstring when said bowstring is relaxed during the loading and firing of the arrow;

each of said projections further having a first cut-off formed therein on the forward upper portion of the recessed portion, said cut-off being inclined at an acute angle in the direction of the arrow with respect to the longitudinal axis thereof;

each of said ribs having a second cut-off formed therein on the lower portion thereof, said second cut-off being inclined at an acute angle in the direction of the arrow with respect to the longitudinal axis thereof;

a first circular notch formed in the nock body in a location at the peripheral end of the first cut-off on a plane intersecting said first cut-off;

a second circular notch formed in the ribs in a location at the peripheral end of the second cut-off on a plane intersecting said second cut-off;

wherein the angle of inclination of the first and second cut-offs are substantially aligned and the first and second circular notches are so formed as to receive therein the nock-location section of the bowstring.

* * * * *